US005950235A

United States Patent [19]

Tata

[11] Patent Number: 5,950,235

[45] Date of Patent: Sep. 14, 1999

[54] PROTECTIVE GARMENT FOR USE BY AN ADULT HOLDING A CHILD

[76] Inventor: Anne-Ferrell Tata, 609 Cavalier Dr., Virginia Beach, Va. 23451

[21] Appl. No.: 09/052,122

[22] Filed: Mar. 31, 1998

[51] Int. Cl.[6] ..... A41D 1/00; A41D 1/22; A41D 3/08; A41D 27/00

[52] U.S. Cl. ..... 2/48; 2/46; 2/50; 2/51; 2/69

[58] Field of Search ..... 2/46, 48, 49.1, 2/49.2, 49.3, 49.4, 49.5, 50, 51, 52, 88, 105, 174, 106, 113, 114, 69, 69.5, 89, 94

[56] References Cited

U.S. PATENT DOCUMENTS 379,032 3/1888 Schloss ..... 2/101
2,258,946 10/1941 Chadwick ..... 2/48
2,955,293 10/1960 Peterson ..... 2/49
4,280,227 7/1981 Brock ..... 2/88

*Primary Examiner*—Jeanette Chapman
*Attorney, Agent, or Firm*—Hunton & Williams

[57] ABSTRACT

A protective garment for use by an adult with an infant comprises a body portion, a neck opening portion and a fastener. The body portion comprises a first and second edge connecting to form a non-zero angle with respect to each other. The neck opening portion forms an opening in the body portion with the neck opening portion being disposed opposite the non-zero angle of the body portion, such that a line bisecting the non-zero angle to the closest point of the neck opening portion passes through the center of the neck opening portion and forms an axis of symmetry for the body portion.

9 Claims, 4 Drawing Sheets

PROTECTIVE GARMENT FOR USE BY AN ADULT HOLDING A CHILD

FIELD OF THE INVENTION

The present invention relates to protective wear for adults and more particularly to protective wear for adults for use with feeding, burping and other handling of infants.

BACKGROUND OF THE INVENTION

Protective garments for use by adults in feeding infants are known. These garments and other protective wear are used after feeding an infant. As is well known, infants frequently burp or regurgitate when being held just after being fed. In the past, towels, cloths or dishrags have been used by adults to protect their clothing during feeding or burping. Also, protective garments have been proposed for use when holding an infant close to the chest. There garment typically cover only a portion of one shoulder in the event the child regurgitates any undigested food onto the adult's shoulder.

These known protective garments have various drawbacks, however. For example, many of the known garments do not provide for a sufficient level of liquid imperviousness to prevent soiling of the clothing. Also, many of these garments do not cover all of the portions of the adult's body that may be soiled by the child's regurgitation. Other drawbacks and disadvantages also exist with respect to know protective garments.

SUMMARY OF THE INVENTION

It is an object of the present invention to overcome these and other drawbacks of the prior art.

It is also an object of the present invention to provide a protective garment for an adult that prevents liquid from soiling the adult's clothing while holding a child.

It is another object of the present invention to provide a protective garment having a shape that conforms to the body of the adult.

It is a further object of the present invention to provide a protective garment that covers the shoulder, bicep, tricep, chest and upper back of the adult.

It is further another object of the present invention to provide a mechanism that enables the protective garment to be hung from a hook or other attachment mechanism for easy access for the adult.

It is also another object of the present invention to provide a protective garment that secures around the adult's neck to prevent the garment from shifting during use while affording quick removal of the protective garment.

It is yet another object of the present invention to provide a protective garment that may simultaneously protect both shoulders of the adult without adjustment.

According to these and other objects of the present invention, a protective garment for use by an adult with an infant according to the present invention comprises a body portion, a neck opening portion, and a fastener. The body portion may comprise a first and second edge connecting to form a non-zero angle with respect to each other. Additionally, the neck opening portion may form an opening in the body portion. The neck opening portion may be disposed opposite the non-zero angle of the body portion, such that a line from the point of the non-zero angle to the closest point of the neck opening portion forms an axis of symmetry for the body portion. The fastener may be connected to the neck opening portion to connect two edges of neck opening portion to form an enclosure.

According to another embodiment of the present invention, a protective garment for use by an adult with an infant comprises a body portion, a neck opening portion, and a fastener. The body portion may have a shape that when used on an adult, snugly conforms to the adult to cover both shoulders, a portion of the chest, a portion of the back and a significant portion of the upper arm of the adult. The neck opening portion may be connected to the body portion and the fasteners may be connected to the neck opening to connect two portions of the neck opening portion to form an enclosure.

According to another embodiment of the present invention, a protective garment for use by an adult with an infant comprises a body portion, a semi-circular neck portion and first and second fastener portions. The body portion may comprise first and second edges forming a first non-zero angle, third and fourth edges forming a second non-zero angle, the third edge and the first edge forming a third non-zero angle, and fifth and sixth edges forming a fourth non-zero angle, the fifth and second edges forming a fifth non-zero angle. The semi-circular neck portion may comprise first and second terminating ends with the first terminal end connecting to the fourth edge and the second terminal end connecting to the sixth edge. The first fastener portion may connect to the first terminating end and the second fastener may connect to the second terminating end.

A protective garment according to the present invention provides the advantage of covering the breast/chest area, upper back area, shoulders and a significant portion and/or all of the upper arms of the wearer. Additionally, another advantage provided by the protective garment according to the present invention is that the garment covers both shoulders of the wearer so that the child being held may be moved from one shoulder to the other without having to move the protective garment. The material selected for the protective garment according to the present invention may also provide the advantage of being resistant to wear, easily washable and reusable.

Other advantages of the present invention will be apparent from reviewing the detailed description of the preferred embodiments set forth herein.

BRIEF DESCRIPTION OF THE DRAWINGS

The above description, as well as further objects and features of the present invention, will be more fully appreciated by reference to the following detailed description of the present invention in conjunction with the accompanying drawings in which.

DETAILED DESCRIPTION OF THE PREFERRED EMBODIMENTS

Figure 1:
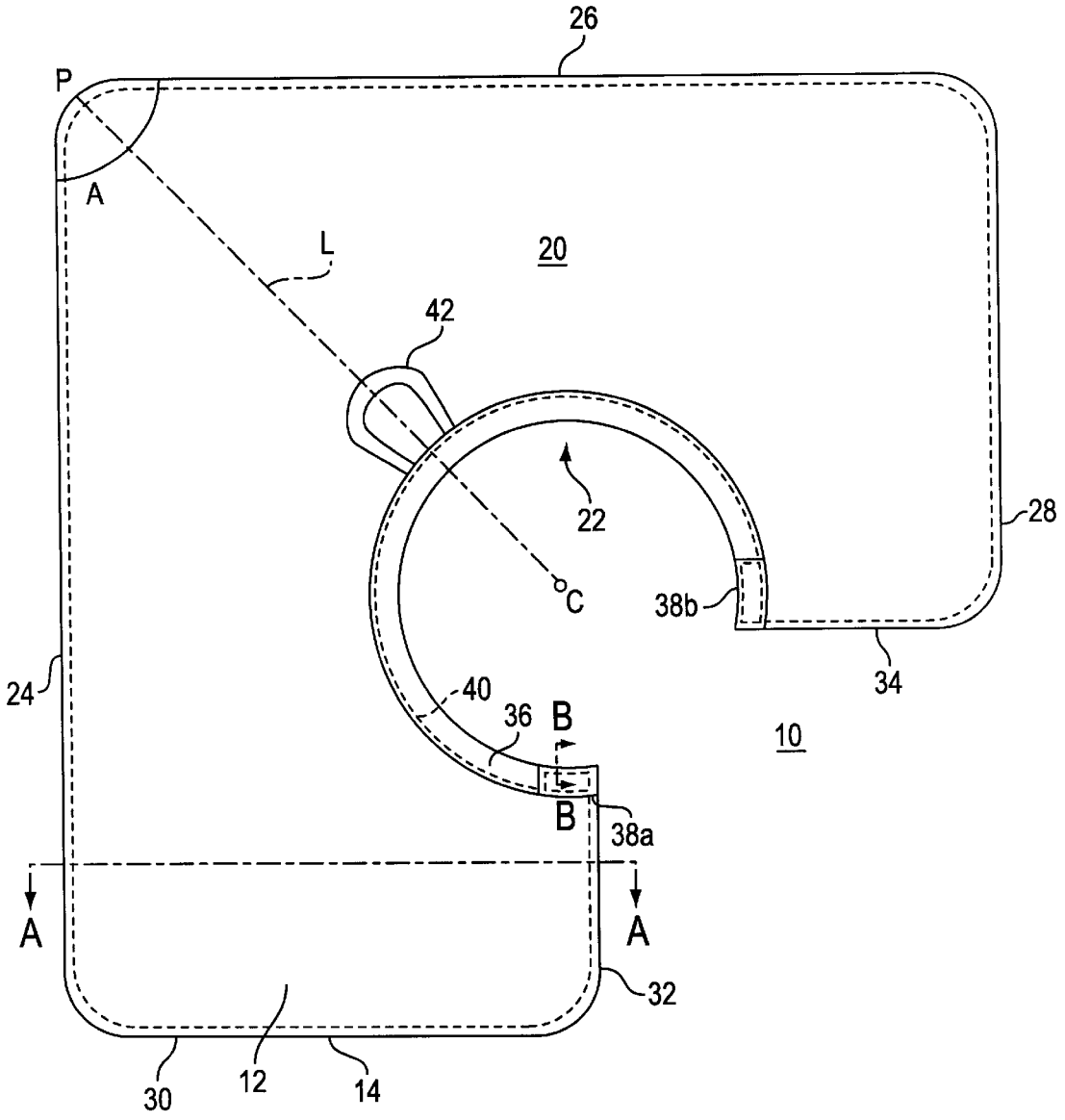
FIG. 1 is an overhead view of a protective garment according to one embodiment of the present invention.
Figure 2:
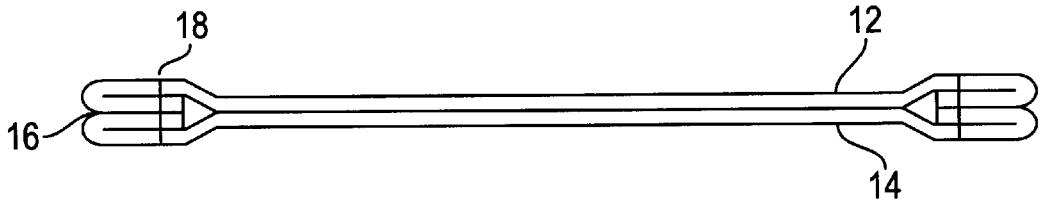
FIG. 2 is a cut-away section view taken along line A—A of the protective garment shown in FIG. 1.

A protective garment according to the present invention is depicted in FIG. 1. As shown in FIG. 1 and in the other accompanying figures, a protective garment 10 is depicted. As seen in FIGS. 1 and 2, protective garment 10 may comprise a bottom sheet 12 and a top sheet 14. Bottom sheet 12 and top sheet 14 may both be folded at their outer proximal ends as shown in FIG. 2 and adhesive material 16 may be used to adhere bottom sheet 12 and top sheet 14. Additionally, stitching 18 may be provided around the outer proximal ends of protective garment 10 to keep bottom sheet 12 and top sheet 14 connected. Other methods for connecting two materials may also be used such as heat bonding, taping, etc.

As shown in FIG. 1, protective garment 10 may have a general diamond or heart shape. Protective garment 10 may be comprised of two general portions: body cover portion 20 and neck opening portion 22. Body cover portion 20 may comprise first and second long edges 24 and 26, first and second short edges 28 and 30, and first and second matching edges 32 and 34. Neck opening portion 22 may comprise a neck cuff portion 36, and fastener portions 38A and 38B. Neck opening portion 22 may comprise a generally circular shape so as to secure protective garment 10 around the neck of a user. Neck cuff portion 36 may be affixed to body cover portion 20 by stitching 40, for example. Other mechanisms for fastening neck cuff portion 36 to body cover portion 20 may also be provided. Neck opening portion 22 may also comprise fastener portions 38A and 38B.

Neck opening portion 22 may be positioned so that a line, L, drawn from the point of inflection, P, of the juncture of first and second long edges 24 and 26 to the nearest point on neck opening portion 22 passes through the center, C, of neck opening portion 22. That line may also be provided such that line, L, bisects angle, A, formed by first and second long edges 24 and 26. Also, the shape of body portion 10 may be such that line L forms an axis of symmetry for body portion 10. By providing a symmetrical shape, body portion 10 may be worn on either shoulder and cover the same portions of the wearer's body.

Figure 3:
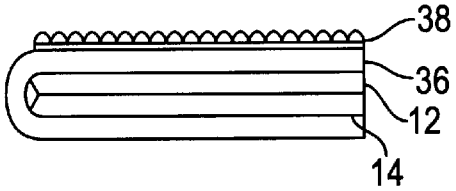
FIG. 3 is a cut-away section view taken along line B—B of a protective garment as shown in FIG. 1.

As depicted in FIG. 3, for example, fastener portions 38A and 38B may be hook and loop fastening mechanisms for example. According to one embodiment, the hook and loop mechanism may compromise VELCRO™ for example. According to one embodiment, UNIQUE VELCRO™ may be used for fastener portions 38A and 38B. Provision of such Velcro-type materials facilitate one handed attachment and release of the protective garment, especially when holding the baby or toddler. If a hook and loop mechanism is provided, one side of neck opening portion 22 is provided with the hook portion and the underside would be provided with the lock portion. The size of neck opening portion 22 may be varied according to the sizes of the adult wearer. Additionally, due to the use of a Velcro-type fastener, a single neck opening portion 22 size may be provided. Given the length of the Velcro-type material, different neck sizes may be accommodated.

Additionally, protective garment 10 may be provided with a hanging portion 42 disposed on one or more sides of protective garment 10. Hanging portion 42 may be affixed to any desired location of protective garment 10. According to one embodiment, hanging portion 42 may be affixed proximal to or on neck opening portion 22 of protective garment 10.

Figure 4:
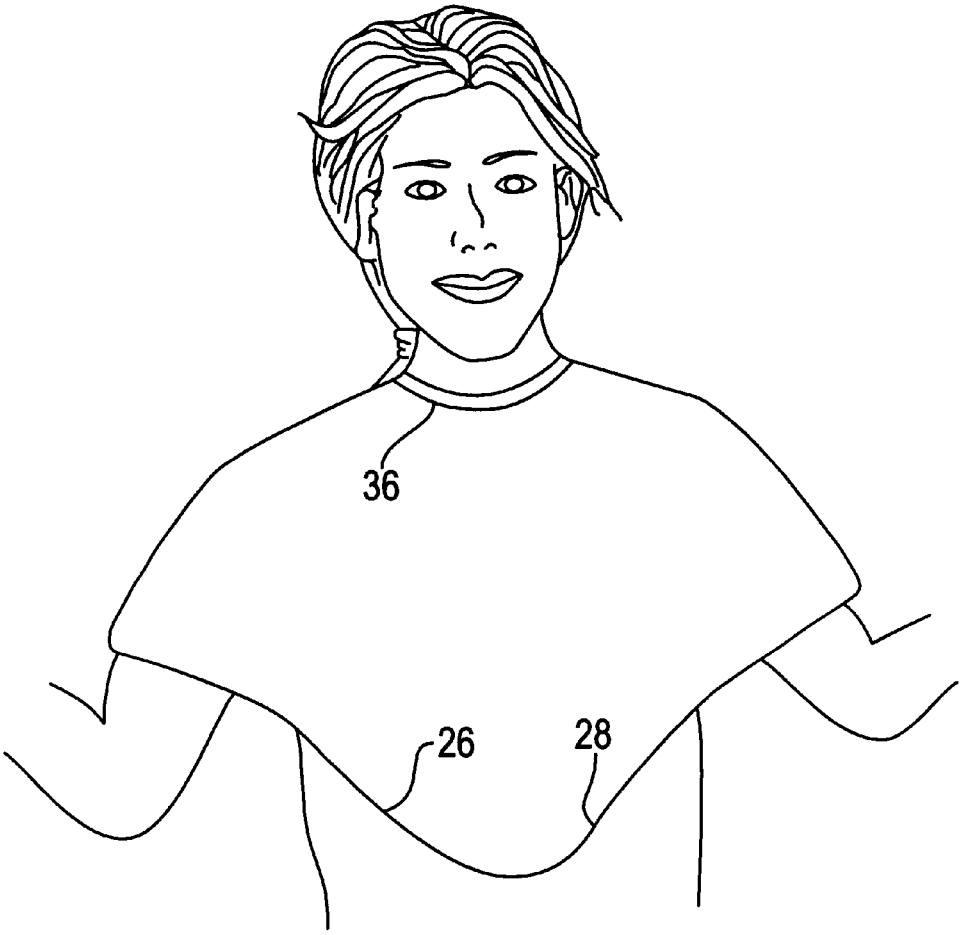
FIG. 4 depicts a protective garment according to an embodiment of the present invention on an adult.
Figure 5:
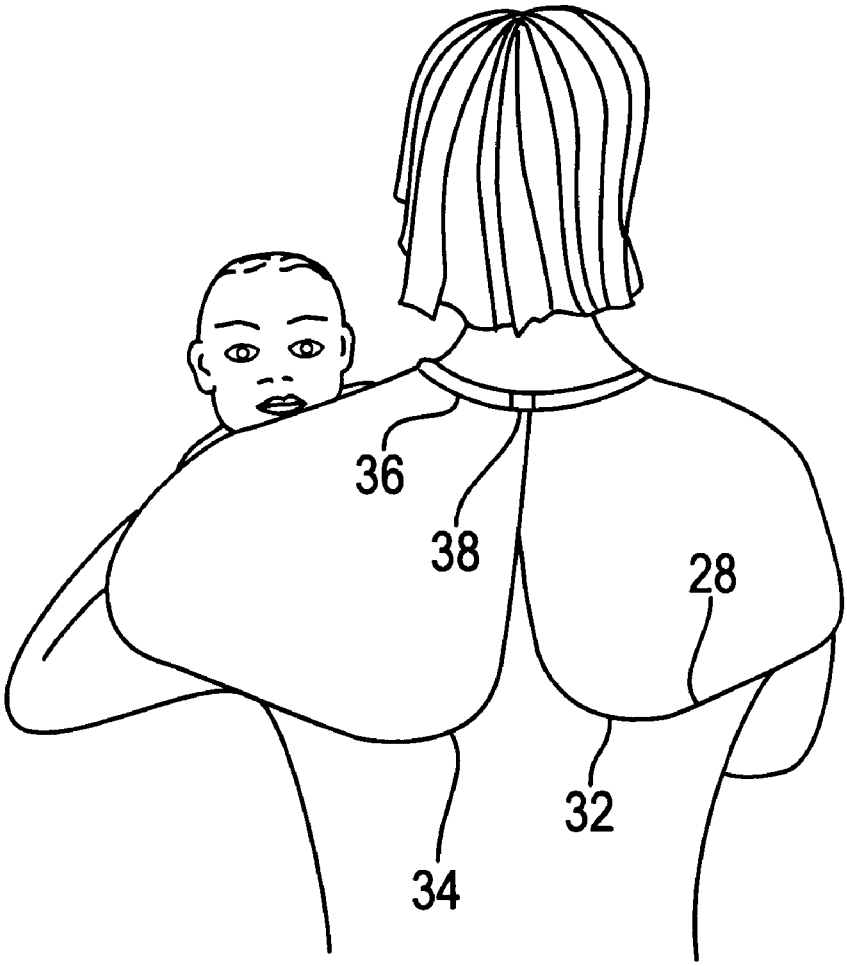
FIG. 5 depicts a protective garment according to the present invention of an adult in use with an infant.

As shown in FIGS. 4 and 5, the shape of protective garment 10 is preferably selected so as to cover the shoulder, a significant portion of and/or all of bicep and tricep, the upper back and breast/chest area of an adult wearer. As these figures illustrate, neck opening portion 22 may be disposed around the neck of the adult. Additionally, first and second long edges 24 and 26 may extend from the middle back and chest of the wearer up to a point along the elbow area of the adult wearer. Additionally, first and second short edges 28 and 30 may extend from the middle back to the opposite shoulder of the wearer and from the stomach area of the adult up to that opposite shoulder. The shape and design of a protective garment according the present invention provides ultimate coverage of the adult wearer during holding of an infant just after feeding. The shape covers not only both shoulders, upper back and neck area of the wearer, but also a significant portion and/or all of the bicep, tricep. This shape provides maximal coverage of the adult for the amount of material used due to its design. A significant advantage over the prior art, for example, allows the garment to extend down from the shoulder and fit snugly along the upper arms of the adult wearer. Additionally, because of the symmetrical nature of the garment, the child being help may be switched from one shoulder to the other and the garment protects all potentially exposed areas of the adult.

As discussed above, protective garment 10 may comprise two sheets. Additional sheets may also be used as desired according to the present invention. According to one embodiment of the present invention, the material selected for protective garment 10 may compromise washable materials. Preferably, such materials do not shrink during use and may be cleaned and reused after soiling by the infant. According to one embodiment of the present invention, top sheet 14 may comprise a light weight material. For example, a soft, polyester cotton blend material may be used. Such material may comprise any type of material that is soft to the touch of a child. For example, in one embodiment, a 50/50 polyester/cotton blend baby blanket material may be provided. Other soft materials may be used. By providing a soft top sheet 14 the protective garment is pleasing to the touch of the child when resting against the adult's shoulder.

Bottom sheet 12 may comprise a single coated fabric. According to one embodiment, the single coated fabric may comprise a fabric that has a soft underside and a liquid impervious upper side. For example, the soft side may comprise a soft material similar to the soft material of top sheet 14. Also, the underside may comprise a suede material. According to one embodiment, the underside of bottom sheet 12 may comprise a soft flannel or similar texture material that is comfortable against the skin and clothing of the adult wearer. The other side of the bottom sheet 12 may comprise a liquid impervious material. Provision of a liquid impervious material prevents penetration of any liquid that may contact top sheet 14 from penetrating through bottom sheet 12 onto the clothing of the adult wearer.

For example, a liquid repellent rubber-like material that prevents food, drool or similar substances from penetrating through the bottom sheet 12 to stain or harm the wearer's clothing may be used. According to one embodiment, BLACKOUT™ or ultra suede material may be used. Also, vinylized fabric, rubberized cotton, special suede and thermal suede may also be used. Other similar materials may also be used as would be recognized by one of ordinary skill in the art.

Other embodiments and uses of the present invention will be apparent to those skilled in the art from consideration of the specification and practice of the invention disclosed herein. The specification and examples should be considered exemplary only. The intended scope of the invention is only limited by the claims appended hereto.

What is claimed is:

1. A protective garment for use by an adult comprising:

a body portion comprising a first and second edge connecting to form a non-zero angle with respect to each other, wherein the body portion comprises two layers, the first layer comprising a soft layer and the second layer comprising a two-ply material consisting essentially of a liquid impervious side and a soft outer side, the liquid impervious layer being interposed between the soft layer and the soft outer side of the two-ply material;

a neck opening portion forming an opening in the body portion, the neck opening portion being disposed opposite the non-zero angle of the body portion, such that a line that bisects the non-zero angle, passes through the closest point of the neck opening portion and passes through a center of the neck opening portion and such that the vertex of the non-zero angle is directed away from the neck opening portion; and a fastener connected to the neck opening portion to connect two edges of neck opening portion to form an enclosure.

2. The protective garment of claim 1 wherein the neck opening portion is disposed in the body portion such that the line defines an axis of symmetry for the body portion.

3. The protective garment of claim 1 further comprising a hanging mechanism that permits the protective garment to be hung.

4. The protective garment of claim 1 wherein the body portion comprises two layers.

5. The protective garment of claim 1 wherein the fastener comprises a hook and loop mechanism.

6. A protective garment for use by an adult comprising:

a body portion having a shape that when used on an adult snugly conforms to the adult to cover substantially only both shoulders, a portion of the chest, a portion of the back and a significant portion of the upper arm of the adult, the body portion comprising a non-zero angle portion, wherein the body portion comprises at least two layers, one layer comprising a soft layer and the second layer comprising a two-ply material consisting essentially of a liquid impervious side and a soft outer side, the liquid impervious layer being interposed between the soft layer and the soft outer side of the two-ply material;

a neck opening portion connected to the body portion and being disposed opposite the non-zero angle of the body portion, such that the vertex of the non-zero angle is directed away from the neck opening portion; and fasteners connected to the neck opening portion to connect two portions of the neck opening portion to form an enclosure.

7. The protective garment of claim 6 further comprising a hanging mechanism that permit the protective garment to be hung.

8. The protective garment of claim 6 wherein the fastener comprises a hook and loop mechanism.

9. A protective garment for use by an adult with an infant comprising:

a body portion comprising:

first and second edges forming a first non-zero angle;

third and fourth edges forming a second non-zero angle, the third edge and the first edge forming a third non-zero angle; and fifth and sixth edges forming a fourth non-zero angle, the fifth and second edges forming a fifth non-zero angle;

wherein the body portion comprises two layers, the first layer comprising a soft layer and the second layer comprising a two-ply material consisting essentially of a liquid impervious side and a soft outer side, liquid impervious layer being interposed between the soft layer and the soft outer side of the two-ply material;

a semi-circular neck portion comprising first and second terminating ends, the first terminal end connecting to the fourth edge and the second terminal end connecting to the sixth edge; and first and second fastener portions, the first fastener portion connecting to the first terminating end and the second fastener portion connecting to the second terminating end.

* * * * *